United States Patent [19]

Southard

[11] 4,106,139

[45] Aug. 15, 1978

[54] MATTRESS FOUNDATION

[75] Inventor: Robert W. Southard, Lake Jackson, Tex.

[73] Assignee: The Dow Chemical Company, Midland, Mich.

[21] Appl. No.: 633,540

[22] Filed: Nov. 19, 1975

[51] Int. Cl.[2] ..... A47C 23/00

[52] U.S. Cl. ..... 5/186 R; 5/345 R; 5/361 R

[58] Field of Search ..... 5/186 R, 345, 355, 361, 5/361 B; 297/DIG. 1

[56] References Cited

U.S. PATENT DOCUMENTS

| | | | |
|---|---|---|---|
| 3,135,974 | 6/1964 | Roman | 5/345 R |
| 3,197,357 | 7/1965 | Schulpen | 5/361 B |
| 3,512,191 | 3/1970 | Wall et al. | 5/345 R |
| 3,604,025 | 9/1971 | Mims | 5/345 R |
| 3,724,009 | 4/1973 | Ambrose | 5/345 R |

FOREIGN PATENT DOCUMENTS

| | | | |
|---|---|---|---|
| 434,550 | 9/1935 | United Kingdom | 297/DIG. 1 |

*Primary Examiner*—Paul R. Gilliam
*Assistant Examiner*—Victor N. Sakran

[57] ABSTRACT

An improved mattress foundation is prepared by splitting a foam slab along a corrugated path to provide two slabs, each having a corrugated face and each being supported by a rigid base to form a mattress foundation.

9 Claims, 6 Drawing Figures

MATTRESS FOUNDATION

One of the more common mattress foundations employed at the present time is the so-called box spring. Generally such box springs provide substantial protection for a mattress supported thereby and in the case of the more resilient or softer mattress add substantially to the comfort of the sleeper. Such box springs are generally complex in construction and require a significant amount of manual labor to assemble the metallic spring assembly and apply the padding and covering.

It would be desirable if there were available an improved mattress foundation.

It would also be desirable if there were available an improved mattress foundation which could be prepared with a minimal amount of labor.

It would also be desirable if there were available an improved mattress foundation which is simply and readily fabricated.

These benefits and other advantages in accordance with the present invention are achieved in a mattress foundation comprising in cooperative combination a generally rectangular slab-like cushioning element, the cushioning element having a first or upper major surface and a second or lower major surface, the cushioning element defining a plurality of corrugations on the second surface and the first surface being of a generally planar configuration, a support member disposed adjacent the second surface and in contact with at least a portion thereof, the support member adapted to maintain the cushioning element at a desired height above a support plane such as a floor.

Further features and advantages of the present invention will become more apparent from the following specification taken in connection with the drawing wherein.

Figure 1:
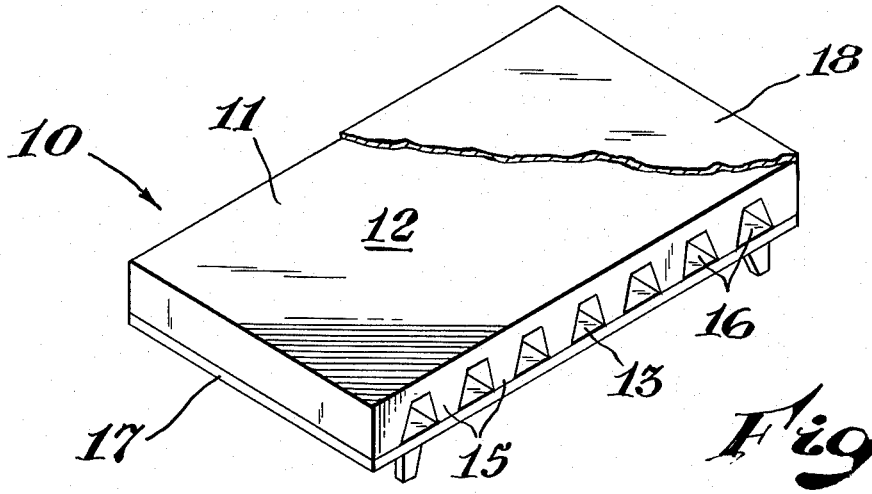
FIG. 1 is a partly cut-away view of a mattress foundation in accordance with the present invention.

In FIG. 1 there is schematically depicted a partially cut-away view of a mattress foundation in accordance with the present invention generally designated by the reference numeral 10. The mattress foundation 10 comprises a generally rectangular slab-like cushioning element 11. The cushioning element 11 has a first major surface 12. The surface 12 has a generally planar configuration. The cushioning element 11 has a second surface 13 generally oppositely disposed to the surface 12 and parallel thereto. The surface 12 is the upper surface of the cushioning element 11 and the surface 13 is the lower surface. The second or lower surface 13 is a generally corrugated configuration having a plurality of generally linear projections defining therebetween a plurality of troughs or grooves 16. The projections 15 and the grooves 16 extend the entire width of the cushioning element 11. A support means 17 is disposed beneath the cushioning element 11 and engages a portion of the second surface 13 which coincides with the terminal portions of the projections 15. A ticking or cover 18 shown partially cut-away is disposed over the cushioning element 11 and affixed to the support 17.

Figure 2:
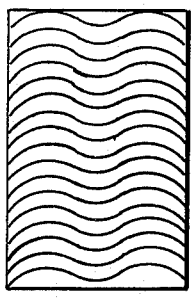
FIGS. 2, 3 and 4 depict corrugation patterns which may be employed with mattress foundations.

In FIG. 2 there is depicted a pattern 20 showing a surface 21 having a plurality of elongate projections 22 defining therebetween a plurality of grooves 23. The pattern shown in FIG. 2 is also satisfactory as a pattern for corrugations in the second surface of cushioning elements for the preparation of mattress foundations in accordance with the present invention. The pattern 20 is particularly suited for single beds wherein it is desired to minimize end-to-end motion of the upper surface of the mattress foundation with a particular padding element if linear lateral projections such as those depicted in FIG. 1 do not possess desired rigidity.

Figure 3:
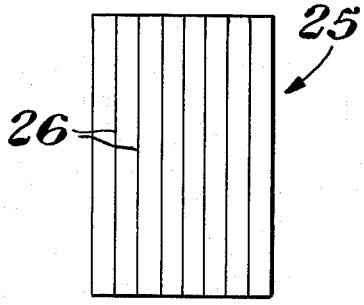

FIG. 3 schematically represents a third pattern designated by the reference numeral 25. The pattern 25 has a plurality of corrugations or ridges extending generally longitudinally. The ridges are indicated by the reference numeral 26. The pattern 25 is particularly desirable where end-to-end motion is not desired and minor lateral movement of the surface is desired.

Figure 4:
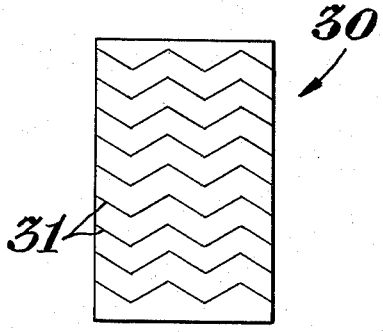

FIG. 4 depicts an alternate pattern of corrugations generally designated by the reference numeral 30. The reference numeral 31 indicates projections generally equivalent to the projections 15 of FIG. 1. The projections or corrugations of the pattern 30 extend laterally from side-to-side on the mattress and are arranged in a zig-zag fashion wherein adjacent corrugations are parallel. The pattern 30 provides a mattress foundation which maximizes the resistance to motion of the upper surface of the foundation from either side-to-side or heat-to-foot employing a minimal weight of padding material.

Figure 5:
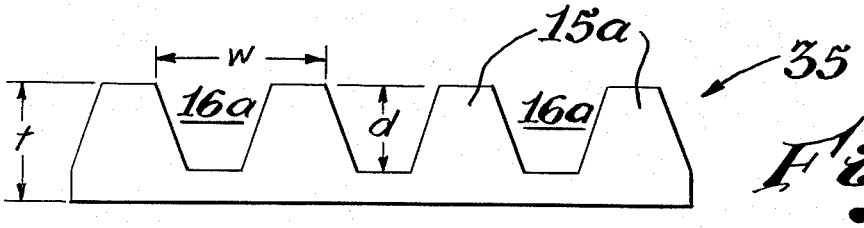
FIG. 5 depicts certain dimensions of corrugations.

In FIG. 5 there is schematically depicted an end view of a portion of a padding element useful for the preparation of mattress foundations in accordance with the present invention generally designated by the reference numeral 35. The cushioning element 35 defines a plurality of projections 15*a* and a plurality of grooves 16*a*. The depth of such grooves are indicated by the reference numeral "*d*." The wavelength of the corrugations is indicated by "*w*" and the thickness indicated by "*t*," "*t*" and "*w*" both being in centimeters.

Figure 6:
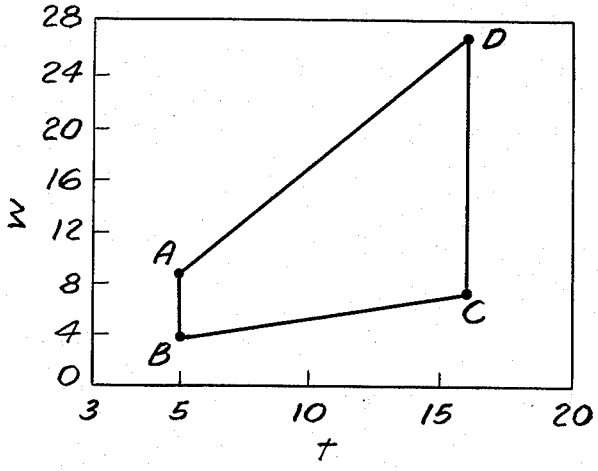
FIG. 6 is a graph showing the relationships between dimensions of corrugations.

FIG. 6 is a plot of the thickness "*t*" verses the wavelength of corrugation. The quadrilateral defined by the lines joining the points AB, BC, CD, and AD provide a region of preferred corrugation dimension wherein the dimension "*d*" is from about 0.4 to 0.95*t*.

Beneficially, cushioning elements suitable for the preparation of mattress foundations in accordance with the present invention are prepared from synthetic resinous thermoplastic foams. Satisfactory and desirable cushioning elements are prepared from foams which have a 25 percent indentation load deflection of 15 to 60 as measured by The American Society for Testing Materials, Specifications 1564 for flexible slabstock and in the case of molded foundations, D2406; the ILD being determined at 25 percent compression. The ratio of the 65 percent ILD to 25 percent ILD should be between about 1.6 to 4 and the density of the foam advantageously lies between 1.0 pounds per cubic foot and 5 pounds per cubic foot and beneficially from 1.5 to 5 pounds per cubic foot. Particularly desirable foams for the preparation of cushioning elements for mattress foundations of the present invention are disclosed in U.S. Pat. No. 3,878,133, the teaching of which is herewith incorporated by reference. The selection of the appropriate foam plastic material for the cushioning element is of course dependent upon the rigidity or lack of rigidity desired in the finished product. The selection of the appropriate stiffness or resiliency of foam is well within the ability of those skilled in the bedding art. Beneficially, the cushioning elements can be prepared from a rectangular slab of material and the slab is cut to provide a corrugated surface of the appropriate depth. Such cutting can be accomplished by means of a hot wire, a band knife of the variety commonly employed for cutting rubber and the like well known tools.

Corrugations such as those represented in FIGS. 2 and 4 can be readily prepared by deforming a rectangular slab of cushioning material between nutating discs and cutting the foam while partially compressed as is conventionally done in foam convoluting cutting apparatus and also by molding. In the event that the foundation is molded an integral cover may be applied during molding. A wide variety of supports such as in support 17 may be employed. An open wooden frame having one or more layers of corrugated paperboard is satisfactory; alternately, the support may be a plywood, composition board, or the like. Beneficially, the cover such as the cover 18 is of any desirable flexible material including fabric, plastic film, or the like and is advantageously affixed to the support 17. In many instances, it is not necessary to affix the cushioning element such as the element 11 to a support such as the support 17. Generally the cushioning element is satisfactorily retained by the cover 18. However, pressure sensitive adhesives may advantageously be employed to adhere the projections 15 to the adjacent surface of the support 17 if the cushioning element is especially soft or flexible.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A mattress foundation comprising in cooperative combination a generally rectangular slab-like cushioning element, the cushioning element having a first or upper major surface and a second or lower major surface, the cushioning element defining a plurality of corrugations on the second surface and the first surface being of a generally planar configuration, a support member disposed adjacent the second surface and in contact with at least a portion thereof, the support member adapted to maintain the cushioning element at a desired height above a support plane such as a floor, said mattress foundation having a thickness "*t*," a frequency of corrugation "*w*," and a depth of corrugation "*d*," wherein *d* is from about 0.4 to 0.95T.

2. The mattress foundation of claim 1 including a flexible fabric cover disposed over the cushioning element and affixed to the support.

3. The mattress foundation of claim 1 wherein the thickness *t* and frequency *w* falls within the quadrilateral defined by points A, B, C and D of FIG. 6.

4. The mattress foundation of claim 3 wherein the corrugations are generally sinuous.

5. The mattress foundation of claim 4 wherein the corrugations extend from side-to-side of the mattress foundation.

6. The mattress foundation of claim 1 wherein the corrugations extend from end-to-end of the mattress foundation.

7. The mattress foundation of claim 1 wherein the cushioning element has a 25 percent indentation load deflection of from about 15 to 60 pounds per 50 square inches.

8. The mattress foundation of claim 7 wherein ratio of the 65 percent indentation load deflection to the 25 percent load deflection is between about 1.6 and 4.

9. A mattress foundation comprising in cooperative combination a generally rectangular slab-like cushioning element, the cushioning element having a first or upper major surface and a second or lower major surface, the cushioning element defining a plurality of corrugations on the second surface and the first surface being of a generally planar configuration, the cushioning element having a thickness "*t*," a frequency of corrugation "*w*" and a depth of corrugation "*d*" wherein "*d*" is from about 0.4 to 0.95*t*, the thickness "*t*" and frequency "*w*" falling within the quadrilateral defined by points A, B, C and D of FIG. 6, the cushioning element having a 25 percent indentation load deflection of from about 15 to 60 pounds per 50 square inches and the ratio of the 65 percent indentation load deflection to the 25 percent load deflection is between about 1.6 and 4, a support member disposed adjacent the second surface and in contact with at least a portion thereof, the support member adapted to maintain the cushioning element at a desired height above a support plane such as a floor.

* * * * *